US009631247B2

(12) United States Patent
Pedersen

(10) Patent No.: US 9,631,247 B2
(45) Date of Patent: Apr. 25, 2017

(54) DISPLACEMENT OF SCRAPING ROLLERS

(71) Applicant: Jasopels A/S, Bording (DK)

(72) Inventor: Kurt Pedersen, Vinderup (DK)

(73) Assignee: Eikon Technologies Holding Sarl., Luxembourg (LU)

( * ) Notice: Subject to any disclaimer, the term of this patent is extended or adjusted under 35 U.S.C. 154(b) by 110 days.

(21) Appl. No.: 14/423,977

(22) PCT Filed: Aug. 16, 2013

(86) PCT No.: PCT/EP2013/067106
§ 371 (c)(1),
(2) Date: Feb. 25, 2015

(87) PCT Pub. No.: WO2014/032987
PCT Pub. Date: Mar. 6, 2014

(65) Prior Publication Data

US 2015/0218664 A1 Aug. 6, 2015

(30) Foreign Application Priority Data

Aug. 30, 2012 (DK) ..... 2012 70525

(51) Int. Cl.
*C14B 1/10* (2006.01)
*C14B 15/00* (2006.01)
*C14B 17/02* (2006.01)

(52) U.S. Cl.
CPC ..... *C14B 1/10* (2013.01); *C14B 15/00* (2013.01); *C14B 17/02* (2013.01)

(58) Field of Classification Search
CPC .... C14B 1/02; C14B 1/04; C14B 1/10; C14B 17/00; C14B 17/02; C14B 17/04; C14B 17/06
See application file for complete search history.

(56) References Cited

U.S. PATENT DOCUMENTS 2,896,438 A * 7/1959 Larsson ..... C14B 1/02 69/46
3,048,995 A * 8/1962 Browning ..... C14B 1/02 69/46

(Continued)

FOREIGN PATENT DOCUMENTS

DK 156 669 B3 10/1986
EP 2 093 299 A1 8/2009

(Continued)

OTHER PUBLICATIONS

International Search Report completed Oct. 31, 2013 for International Application No. PCT/EP2013/067106.

(Continued)

*Primary Examiner* — Shaun R Hurley
(74) *Attorney, Agent, or Firm* — Brinks Gilson & Lione

(57) ABSTRACT

An apparatus is disclosed for processing the skin side (5) of a tubular pelt (3), the apparatus comprising an elongated tapering mandrel (1) for supporting the pelt with its skin side turned outwards, a scraping device comprising a first set of primary scraping roller (6, 7) arranged on opposing sides of the mandrel and a second set of primary scraping rollers (8, 9) arranged on other opposing sides of the mandrel, the scraping device further comprising primary rotation means (6, 7, 8, 9) for rotating said primary scraping rollers during processing of a pelt so as to engage a skin side of the pelt, moving means for conducting a relative movement between the scraping device and the mandrel in the longitudinal direction of the mandrel, and displacement means for displacing at least one scraping roller in the direction of the axis of rotation of said scraping roller.

14 Claims, 7 Drawing Sheets

(56) References Cited

U.S. PATENT DOCUMENTS

| | | | | |
|---|---|---|---|---|
| 3,744,279 | A * | 7/1973 | Pavlov | C14B 1/10 69/46 |
| 4,745,782 | A | 5/1988 | Larsen | |
| 4,787,221 | A * | 11/1988 | Johansson | C14B 1/26 69/40 |
| 2013/0139560 | A1* | 6/2013 | Pedersen | C14B 1/02 69/44 |
| 2015/0052955 | A1* | 2/2015 | Pedersen | C14B 1/02 69/40 |

FOREIGN PATENT DOCUMENTS

| | | | |
|---|---|---|---|
| FI | 105 107 | B | 9/1996 |
| WO | WO 2011/116771 | A1 | 9/2011 |
| WO | WO 2012/019606 | A1 | 2/2012 |

OTHER PUBLICATIONS

Written Opinion completed Oct. 31, 2013 for International Application No. PCT/EP2013/067106.

* cited by examiner

DISPLACEMENT OF SCRAPING ROLLERS

This application claims the benefit under 35 U.S.C. §371 of International Application No. PCT/EP2013/067106, filed Aug. 16, 2013, which claims the benefit of Danish Patent Application No. PA 2012 70525, filed Aug. 30, 2012 which are incorporated by reference herein in their entirety.

The present invention relates to an apparatus for processing the skin side of a tubular pelt from a fur animal, in particular from a mink.

BACKGROUND

Scraping rollers of apparatuses for processing of the skin side of pelts of fur animals, such as mink or foxes are worn during use so that the scraping edges or teeth become dull. For that reason, it is necessary to replace the scraping rollers in the apparatus after a certain number of pelts have been processed.

It is an objective of the present invention to provide an apparatus which facilitates the replacing of the scraping rollers.

BRIEF DESCRIPTION OF THE INVENTION

The above objective is achieved with the present invention which relates to an apparatus for processing the skin side of a tubular pelt, the apparatus comprising an elongated tapering mandrel for supporting the pelt with its skin side turned outwards, the mandrel having a thinner, free end from which the tubular pelt is drawn over the mandrel and a thicker end, a scraping device comprising a first set of primary scraping roller arranged on opposing sides of the mandrel and a second set of primary scraping rollers arranged on other opposing sides of the mandrel and being substantially perpendicular oriented with respect to the first set of scraping rollers, the scraping device further comprising primary rotation means for rotating said primary scraping rollers during processing of a pelt so as to engage a skin side of the pelt, moving means for conducting a relative movement between the scraping device and the mandrel in the longitudinal direction of the mandrel, and displacement means for displacing at least one scraping roller in the direction of the axis of rotation of said scraping roller.

By displacing at least one of the scraping rollers of the apparatus but preferably more, such as all scraping rollers of the scraping device away from the mandrel, the scraping rollers become much more accessible for manual interaction such as for replacing the scraping rollers.

It is particularly advantageous that the displacement means are arranged for displacement of the at least one scraping roller in a substantially rectilinear movement, i.e. in a substantially straight movement along the axis of rotation of the individual roller. In this manner, the least space is required within the interior of the apparatus to give room for displacement of the scraping roller or rollers and it is in particular advantageous where a cover is provided for enclosing the scraping device and a part of the mandrel and taking up debris that is removed from the skin side of the pelt by the scraping rollers. When the movement of the scraping roller or rollers is rectilinear in the direction of the axis of rotation of the individual roller or rollers, the openings in the cover for allowing the scraping rollers to extend into the interior of the cover, the compartment, to be of a restricted size and easier to close by means of lids that surround the drive shafts on which the scraping rollers are attached and are removed and installed in place together with the scraping rollers.

The displacement means are preferably arranged for displacement of the at least one scraping roller in a direction which is substantially perpendicular to the longitudinal direction of the mandrel. However, in case the axis of rotation of the scraping roller is slanted with respect to the longitudinal direction of the mandrel, the displacement direction will also be slanted correspondingly.

The displacement means are preferably arranged for displacement of the at least one scraping roller over a distance in the direction of the axis of rotation of the scraping roller that is at least twice the extent of the scraping roller in said direction, in particular between two and three times the extent of the scraping roller in the direction of its axis of rotation. The extent of the scraping rollers in the direction of the axis of rotation is normally in the range of 140 to 165 millimeters. Thus, the displacement means are in particular arranged for displacement of the at least one scraping roller over a distance in the direction of the axis of rotation of the scraping roller that is in the range of 150 to 700 millimeters, preferably 200 to 600 millimeters.

It is preferred that the displacement means are arranged for simultaneous displacement of both rollers of one of said set of primary scraping rollers in the same direction and in particular that the displacement means are arranged for displacement of both rollers of said set of primary scraping rollers over the same distance.

The displacement means may further be arranged for displacement of the other set of primary scraping rollers in a direction perpendicularly to the direction of displacement of the first set of primary scraping rollers.

In case the scraping device further comprises at least one set of secondary scraping rollers, it is preferred that the displacement means are arranged for displacement of the set of secondary scraping rollers.

The apparatus according to the present invention may comprise a cover having a compartment and an outlet, wherein said cover is configured for enclosing a part of the mandrel and at least one set of primary scraping rollers of the scraping device in said compartment during operation, wherein said outlet is arranged in a bottom part of said cover, said bottom part being arranged below said set of primary scraping rollers, wherein said cover comprises walls with inner surfaces configured for leading material removed from said skin side by means of said set of primary scraping rollers towards said bottom part, and wherein the displacement means are arranged for displacing said set of primary scraping rollers out from the compartment of the cover.

The cover encloses preferably both sets of primary scraping rollers in said compartment, and the displacement means are arranged for displacing both sets of primary scraping rollers out from the compartment of the cover.

Generally, it is preferred that the cover is common to all scraper rollers of the scraping device and wherein the displacement means are arranged for displacing all scraping rollers out from the compartment of the cover.

BRIEF DESCRIPTION OF THE FIGURES

An embodiment of the present invention is disclosed in the drawing of which

DETAILED DESCRIPTION OF EMBODIMENTS OF THE PRESENT INVENTION

Figure 1:
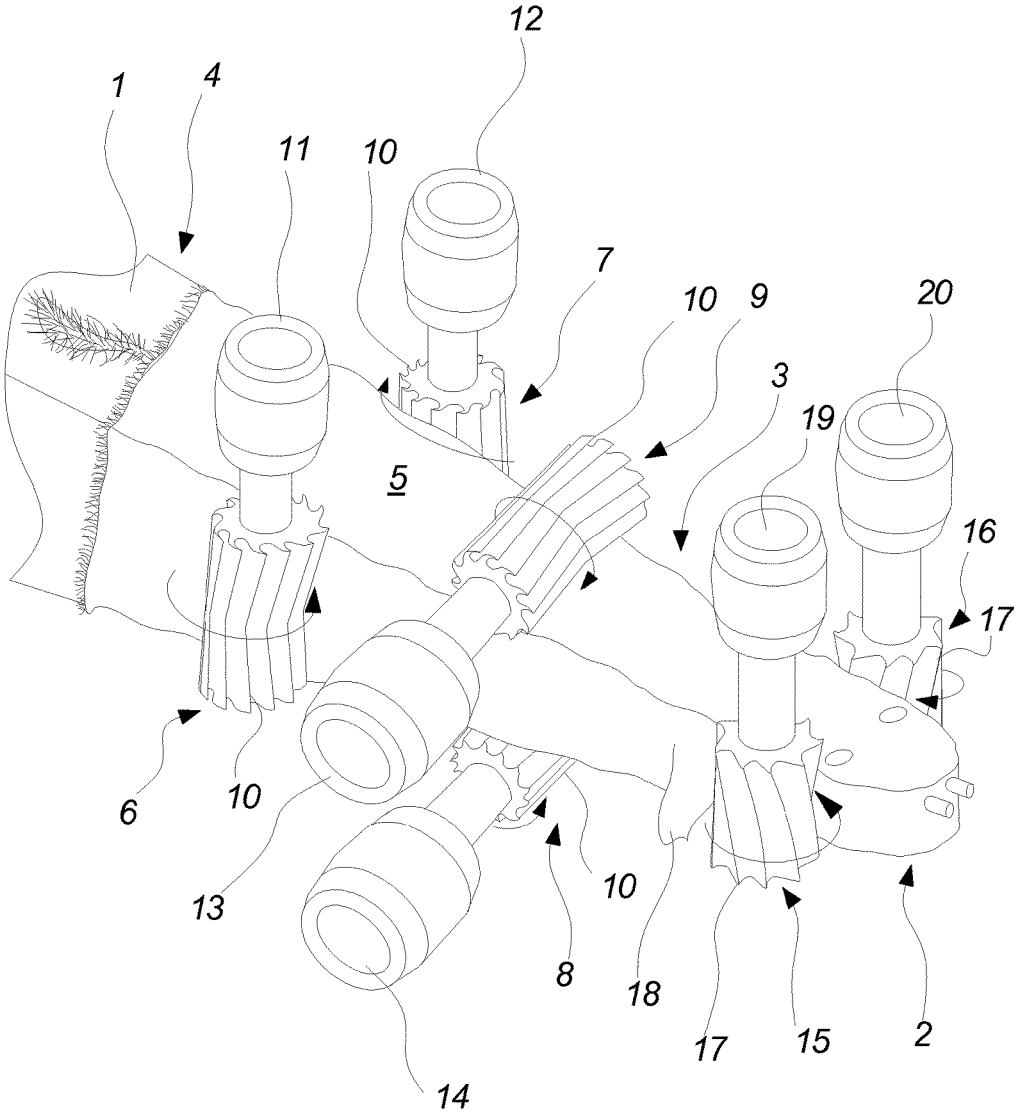
FIG. 1 is a perspective view showing some of the elements of the apparatus.

The apparatus of the present invention of which some parts only are shown in FIG. 1 comprises an mandrel 1 which is tapering towards a thinner, free end 2 from which the tubular pelt 3 is drawn over the mandrel and a thicker end 4 which is connected to and supported by the frame of the apparatus (not shown) where the drive means are arranged for driving the mandrel 1 in the longitudinal direction thereof during operation of the apparatus for scraping the skin side 5 of the pelt 3 arranged on the mandrel 1.

The apparatus comprises two sets of primary scraping rollers 6, 7, 8, 9 having V-shaped teeth 10 and drive means 11, 12, 13, 14 for driving the scraping rollers 6, 7, 8, 9 in a rotation about corresponding axes. The apparatus further comprises biasing means (not shown) for biasing the teeth 10 of the scraping rollers 6, 7, 8, 9 towards the skin side 5 of the pelt 3 during operation of the apparatus. The apparatus shown in FIG. 1 further comprises a set of secondary scraping rollers 15, 16 having helical teeth 17 for performing an improved scraping of the areas around and in particular beneath the part 18 of the pelt 3 that used to cover the front legs of the fur animals from which the pelt 3 was taken. The secondary scraping rollers 15, 16 are driven by secondary drive means 19, 20.

The drive means 11, 12, 13, 14, 19, 20 of each set of scraping rollers 6, 7, 8, 9, 15, 16 are arranged so that the drive shafts 21 carrying the scraping rollers 6, 7, 8, 9, 15, 16 extend to the same side for each set. Hereby, it is possible to displace both scraping rollers 6, 7, 8, 9, 15, 16 of a set simultaneous away from the mandrel 1 in a direction parallel to the axes of rotation of the scraping rollers 6, 7, 8, 9, 15, 16 of the set for replacement of the scraping rollers 6, 7, 8, 9, 15, 16.

Figure 2:
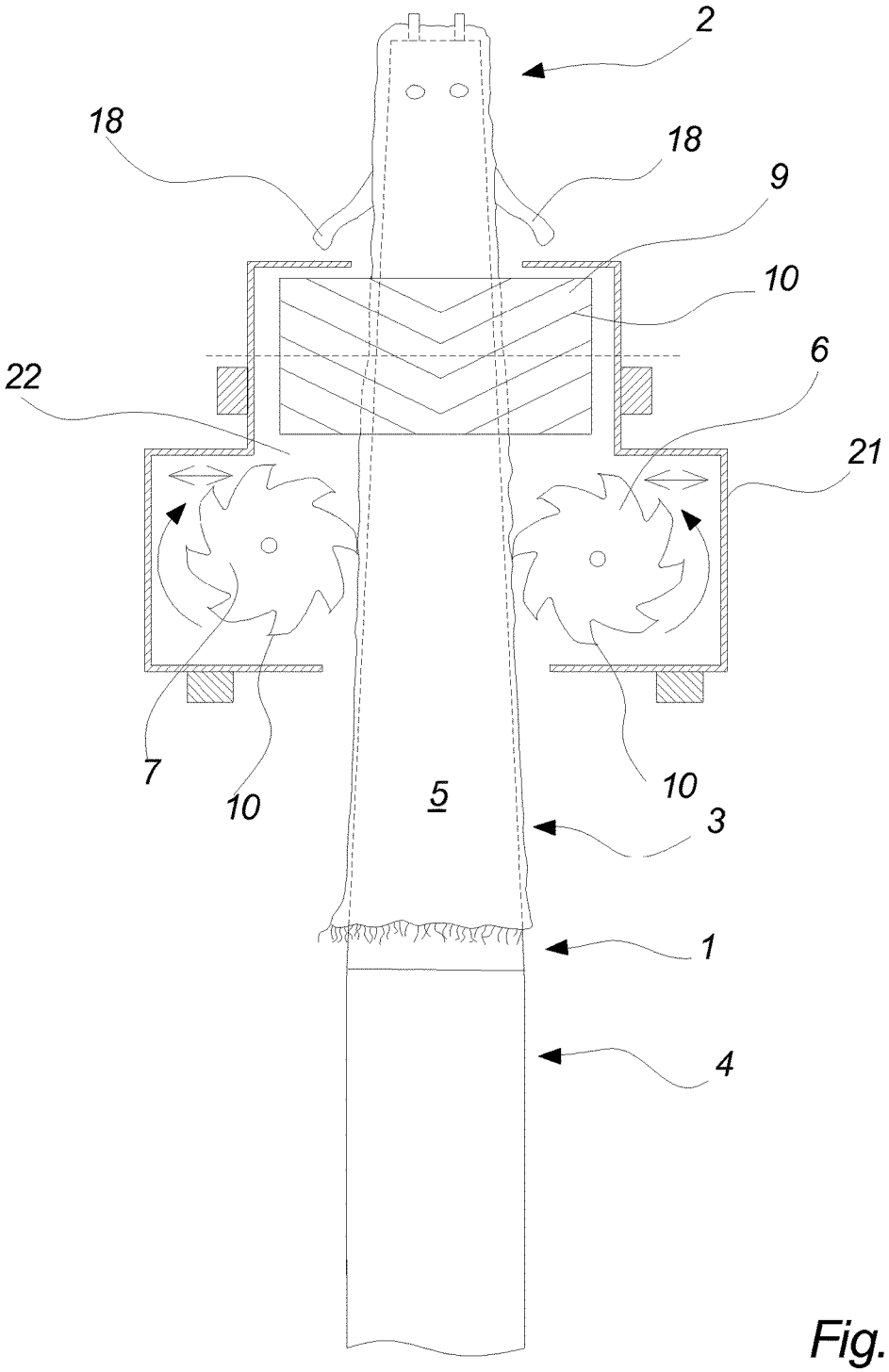
FIG. 2 is a top view of the apparatus of FIG. 1.
Figure 3:
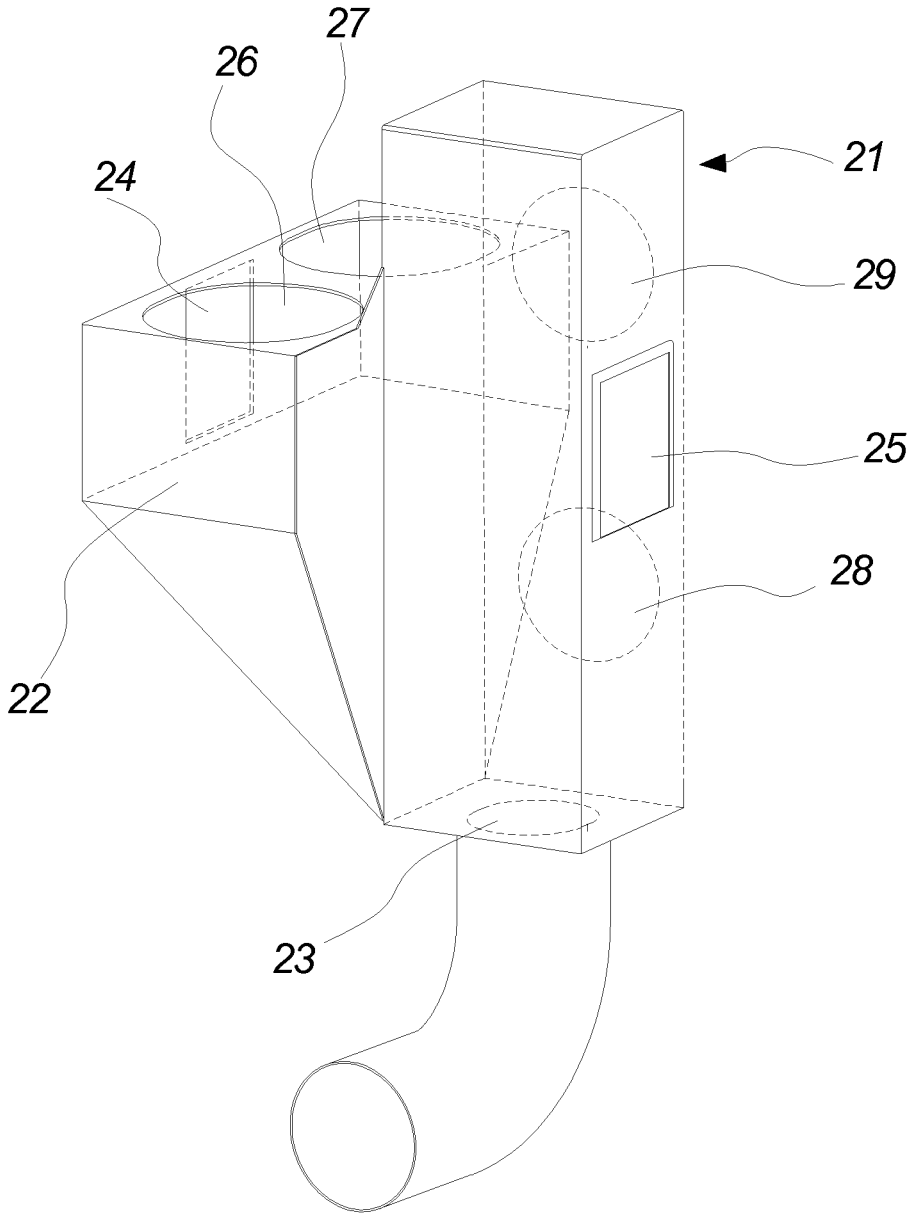
FIG. 3 is a perspective view of the cover for the apparatus of FIGS. 1 and 2.

The displacement of a scraping roller 6, 7, 8, 9, 15, 16 in a direction parallel to its axis of rotation for replacement of the scraping roller 6, 7, 8, 9, 15, 16 is generally relevant as the construction of such apparatus normally leaves only little space for working on the scraping rollers 6, 7, 8, 9, 15, 16 when they are in the operating position, but it becomes particularly advantageous when the apparatus comprises a cover 21 as shown in the embodiment of FIG. 2, where the secondary scraping rollers 15, 16 are omitted. The cover 21, which is shown in perspective in FIG. 3 has a compartment 22 and an outlet 23 and is configured for enclosing a part of the mandrel 1 and both sets of primary scraping rollers 6, 7, 8, 9 during operation of the apparatus so as to collect all debris removed by the scraping rollers 6, 7, 8, 9 from the skin side 5 of the pelt 3 arranged in the mandrel 1 when the mandrel 1 is moved through the cover 21 and passes the scraping rollers 6, 7, 8, 9. The outlet 23 is arranged in a bottom part of said cover 21 below both sets of primary scraping rollers 6, 7, 8, 9 and the cover 21 comprises walls with inner surfaces configured for leading the material removed from the skin side 5 of the pelt 3 towards the outlet at the bottom part, where suction means (not shown) are arranged to remove the debris from the outlet 23. The displacement means of the apparatus are arranged for displacing both sets of primary scraping rollers 6, 7, 8, 9, out from the compartment 22 of the cover 21.

The cover 21 is provided with suitable openings 24, 25 for allowing the mandrel 1 with the pelt 3 arranged thereon to pass through the cover 21 and roller openings 26, 27, 28, 29 for the primary scraping rollers 6, 7, 8, 9 to extend into the compartment 22 of the cover 21. The roller openings 26, 27, 28, 29 are arranged so that sets of primary scraping rollers 6, 7, 8, 9 extend into the compartment 22 from the same side and therefore may be displaced out from the compartment 22 simultaneous, e.g. on a moveable frame on which both primary scraping rollers 6, 7, 8, 9 of the set as well as their drive means 11, 12, 13, 14 are arranged.

Figure 4:
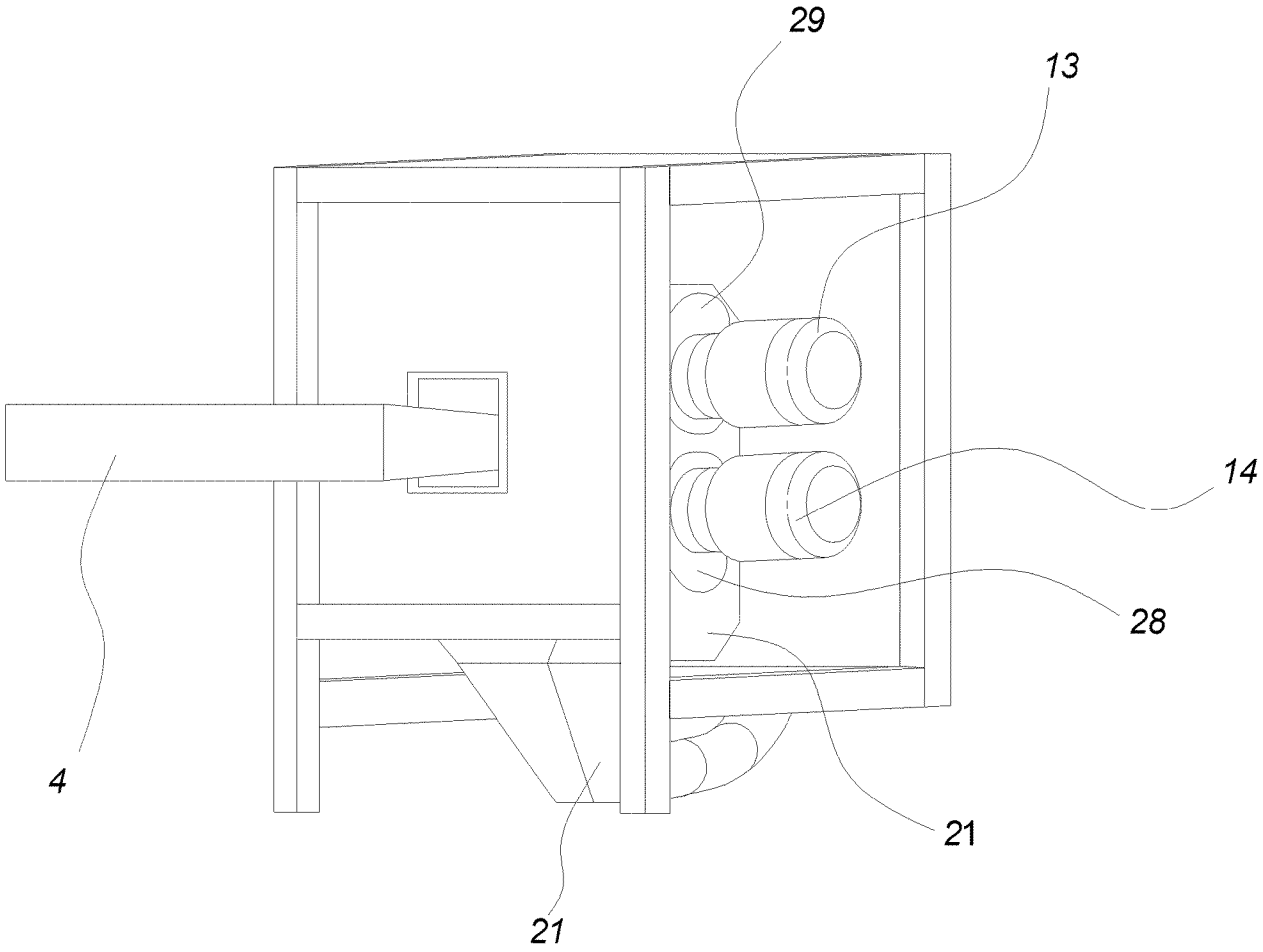
FIG. 4 is a perspective view of an apparatus showing the drive means for a set of primary scraping rollers in an operating position.
Figure 5:
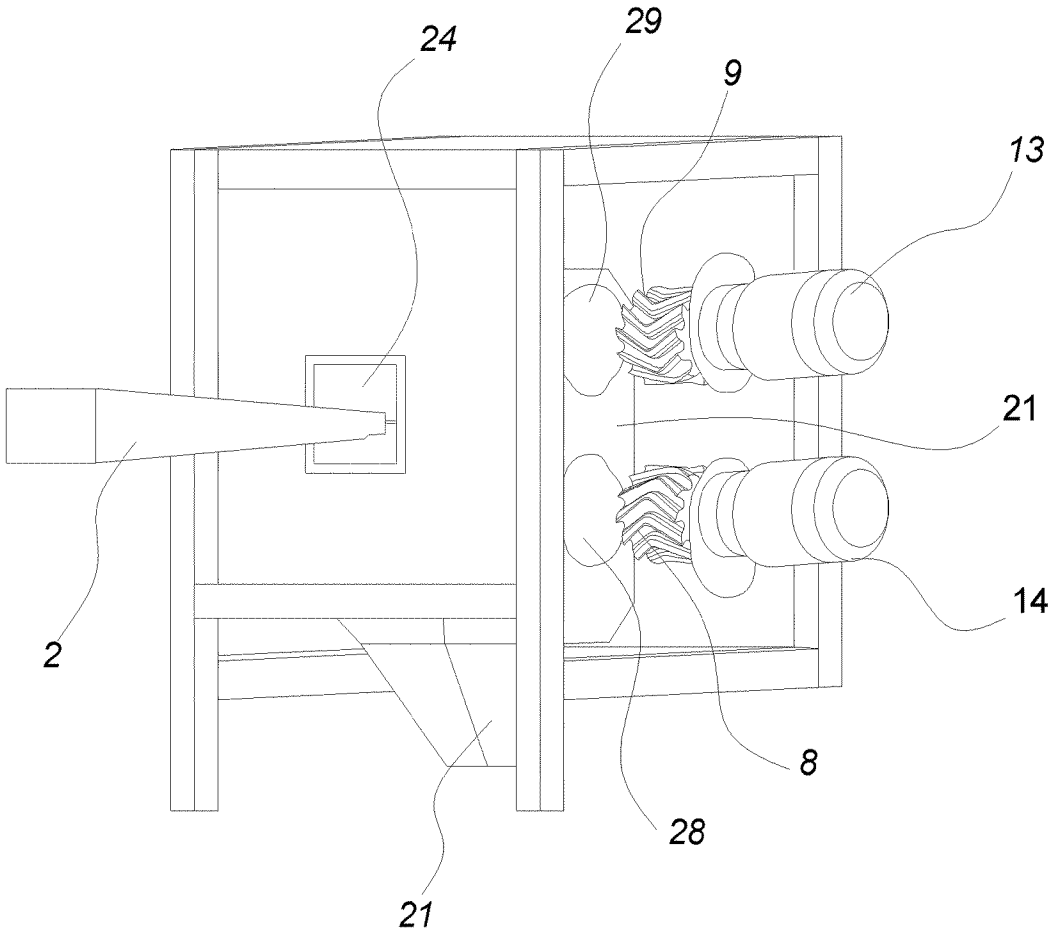
FIG. 5 is a perspective view corresponding to FIG. 4 where the set of primary scraping rollers are in a displaced position.

A perspective side view of an apparatus is shown in FIG. 4 with the drive means 13, 14 for a horizontal set of primary scraping rollers in an operating position, and in FIG. 5 is shown a perspective view corresponding to FIG. 4 where the set of primary scraping rollers 8, 9 are in a displaced position, so that the scraping rollers 8, 9 may be replaced from the drive shafts of the drive means 13, 14.

Figure 6:
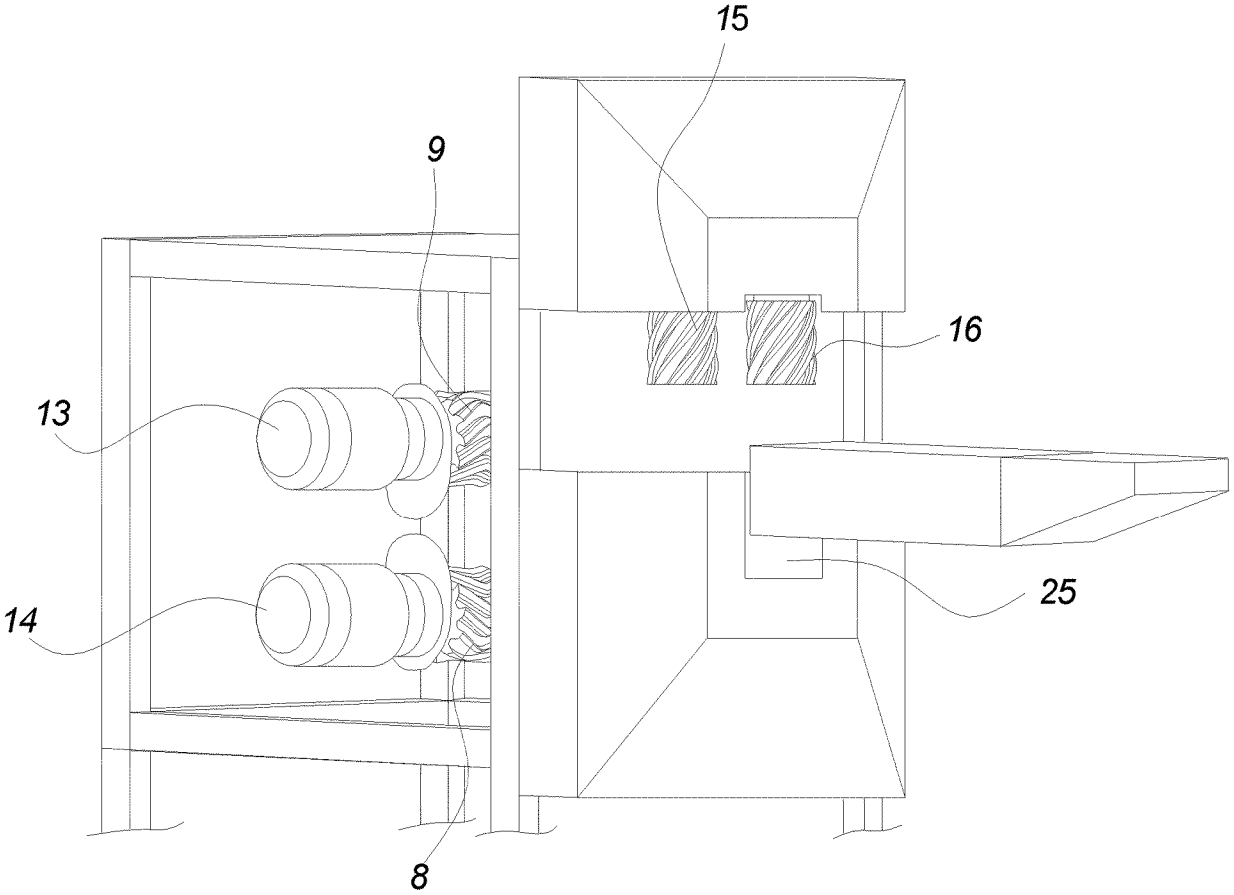
FIG. 6 is a perspective view of the apparatus where a set of secondary scraping rollers are in a displaced position.
Figure 7:
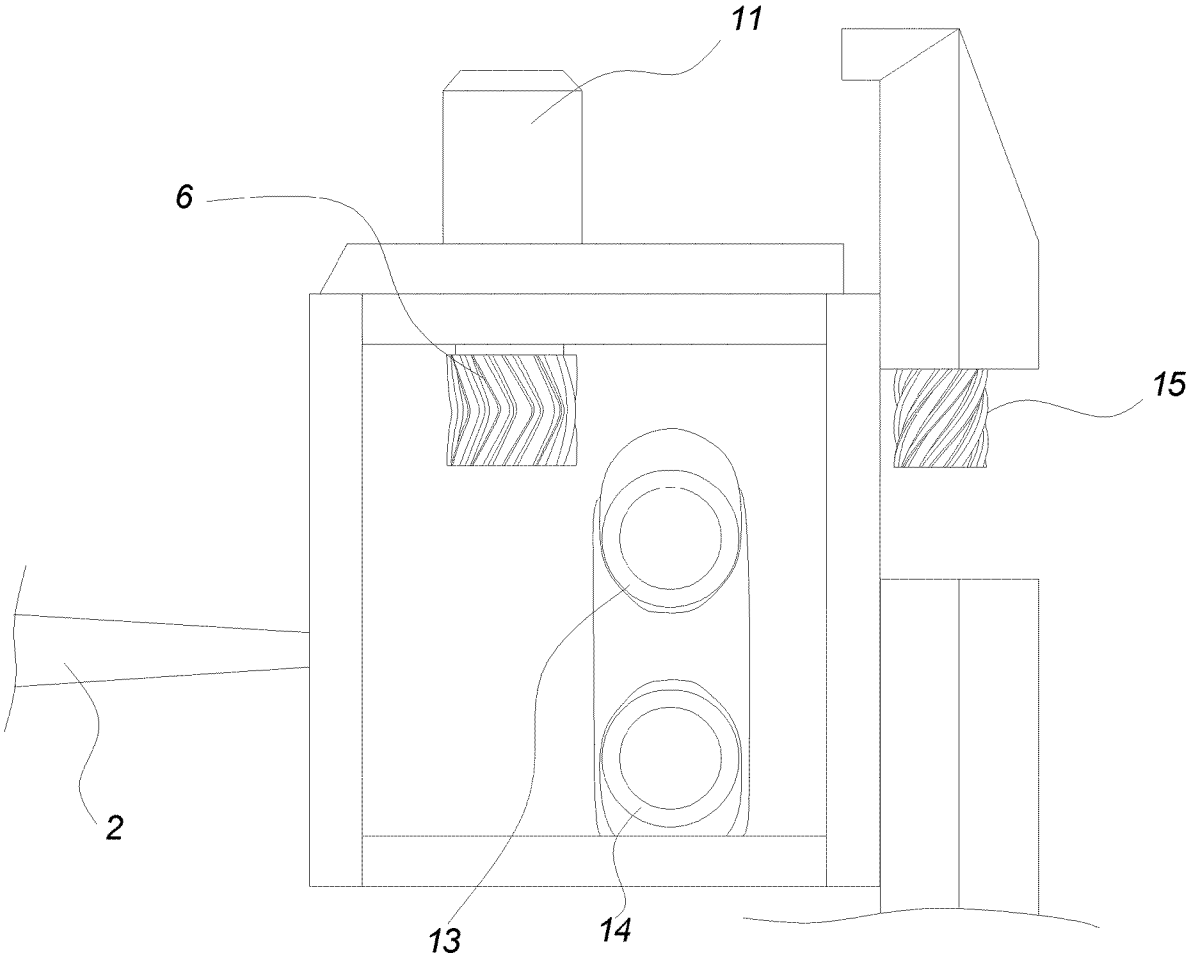
FIG. 7 is a side view of the apparatus where the other set of primary scraping rollers as well as the set of secondary scraping rollers are in a displaced position.

Another perspective view of the apparatus is shown in FIG. 6, where the set of secondary scraping rollers 15, 16 are in a displaced position, and the horizontal set of primary scraping rollers 8, 9 also are in a displaced position. Finally, in a side view of the apparatus in FIG. 7 is the other set of primary scraping rollers 6, 7 as well as the set of secondary scraping rollers 15, 16 shown in a displaced position.

LIST OF REFERENCE NUMERALS

1 Mandrel
2 Thinner, free end of mandrel
3 Tubular pelt
4 Thicker end of mandrel
5 Skin side of the pelt
6, 7, 8, 9 Primary scraping rollers
10 Teeth of the primary scraping rollers
11, 12, 13, 14 Drive means for primary scraping rollers
15, 16 Secondary scraping rollers
17 Helical teeth of secondary scraping rollers
18 Part of the pelt that used to cover the front legs of the fur animals
19, 20 Secondary drive means for secondary scraping rollers
21 Cover
22 Compartment
23 Outlet
24, 25 Openings for mandrel in cover
26, 27, 28, 29 Roller openings for primary scraping rollers in cover

The invention claimed is:

1. An apparatus for processing the skin side of a tubular pelt, the apparatus comprising an elongated tapering mandrel for supporting the pelt with its skin side turned outwards, the mandrel having a thinner, free end from which the tubular pelt is drawn over the mandrel and a thicker end, a scraping device comprising a first set of primary scraping rollers arranged on opposing sides of the mandrel and a second set of primary scraping rollers arranged on other opposing sides of the mandrel and being substantially perpendicularly oriented with respect to the first set of primary scraping rollers, the scraping device further comprising a primary rotation member for rotating said primary scraping rollers during processing of a pelt so as to engage a skin side of the pelt, an actuator for conducting a relative movement between the scraping device and the mandrel in a longitudinal direction of the mandrel, and a displacement member for displacing at least one primary scraping roller together with its primary rotation member in a direction of an axis of rotation of said scraping roller, wherein the displacement member is arranged for displacement of the at least one primary scraping roller together with its primary rotation member in a substantially rectilinear movement.

2. An apparatus according to claim 1, wherein the displacement member is arranged for displacement of the at least one primary scraping roller together with its primary rotation member in a direction which is substantially perpendicular to the longitudinal direction of the mandrel.

3. An apparatus according to claim 1, wherein the displacement member is arranged for displacement of the at least one primary scraping roller together with its primary rotation member over a distance in the direction of the axis of rotation of the at least one primary scraping roller that is at least twice an extent of the at least one primary scraping roller in said direction.

4. An apparatus according to claim 1, wherein the displacement member is arranged for displacement of the at least one primary scraping roller together with its primary rotation member over a distance in the direction of the axis of rotation of the scraping roller that is in a range of 150 to 700 millimeters.

5. An apparatus for processing the skin side of a tubular pelt, the apparatus comprising an elongated tapering mandrel for supporting the pelt with its skin side turned outwards, the mandrel having a thinner, free end from which the tubular pelt is drawn over the mandrel and a thicker end, a scraping device comprising a first set of primary scraping rollers arranged on opposing sides of the mandrel and a second set of primary scraping rollers arranged on other opposing sides of the mandrel and being substantially perpendicularly oriented with respect to the first set of primary scraping rollers, the scraping device further comprising a primary rotation member for rotating said primary scraping rollers during processing of a pelt so as to engage a skin side of the pelt, an actuator for conducting a relative movement between the scraping device and the mandrel in a longitudinal direction of the mandrel, and a displacement member for displacing at least one primary scraping roller together with its primary rotation member in a direction of an axis of rotation of said scraping roller, wherein the displacement member is arranged for simultaneous displacement of both rollers of one of said set of primary scraping rollers in the same direction.

6. An apparatus according to claim 5, wherein the displacement member is arranged for displacement of both rollers of said set of primary scraping rollers over the same distance.

7. An apparatus according to claim 5, wherein the displacement member is arranged for displacement of the other set of primary scraping rollers in a direction perpendicularly to the direction of displacement of the first set of primary scraping rollers.

8. An apparatus according to claim 5, wherein the scraping device further comprises at least one set of secondary scraping rollers and a secondary rotation member for rotating said secondary scraping roller, wherein the displacement member is arranged for displacement of the set of secondary scraping rollers together with its secondary rotation member.

9. An apparatus for processing the skin side of a tubular pelt, the apparatus comprising an elongated tapering mandrel for supporting the pelt with its skin side turned outwards, the mandrel having a thinner, free end from which the tubular pelt is drawn over the mandrel and a thicker end, a scraping device comprising a first set of primary scraping rollers arranged on opposing sides of the mandrel and a second set of primary scraping rollers arranged on other opposing sides of the mandrel and being substantially perpendicularly oriented with respect to the first set of primary scraping rollers, the scraping device further comprising a primary rotation member for rotating said primary scraping rollers during processing of a pelt so as to engage a skin side of the pelt, an actuator for conducting a relative movement between the scraping device and the mandrel in a longitudinal direction of the mandrel, and a displacement member for displacing at least one primary scraping roller together with its primary rotation member in a direction of an axis of rotation of said scraping roller, comprising a cover having a compartment and an outlet, wherein said cover is configured for enclosing a part of the mandrel and at least one set of primary scraping rollers of the scraping device in said compartment during operation, wherein said outlet is arranged in a bottom part of said cover, said bottom part being arranged below said set of primary scraping rollers, wherein said cover comprises walls with inner surfaces configured for leading material removed from said skin side set of primary scraping rollers towards said bottom part, and wherein the displacement member is arranged for displacing said set of primary scraping rollers out from the compartment of the cover.

10. An apparatus according to claim 9, wherein said cover encloses both sets of primary scraping rollers in said compartment, and wherein the displacement member is arranged for displacing both sets of primary scraping rollers out from the compartment of the cover.

11. An apparatus according to claim 9, wherein said cover is common to all scraping rollers of the scraping device and wherein the displacement member is arranged for displacing all scraping rollers out from the compartment of the cover.

12. The apparatus according to claim 1, wherein the displacement member is arranged for displacement of the at least one primary scraping roller together with its primary rotation member over a distance in the direction of the axis of rotation of the scraping roller that is in a range of 200 to 600 millimeters.

13. The apparatus according to claim 1, wherein the displacement member is arranged for simultaneous displacement of both rollers of one of said set of primary scraping rollers in the same direction.

14. The apparatus according to claim 1, further comprising a cover having a compartment and an outlet, wherein said cover is configured for enclosing a part of the mandrel and at least one set of primary scraping rollers of the scraping device in said compartment during operation, wherein said outlet is arranged in a bottom part of said cover, said bottom part being arranged below said set of primary scraping rollers, wherein said cover comprises walls with inner surfaces configured for leading material removed from said skin side set of primary scraping rollers towards said bottom part, and wherein the displacement member is arranged for displacing said set of primary scraping rollers out from the compartment of the cover.

* * * * *